US007775676B2

(12) United States Patent
Yang

(10) Patent No.: US 7,775,676 B2
(45) Date of Patent: Aug. 17, 2010

(54) WEATHER RESISTANT FLORESCENT FIXTURE

(76) Inventor: Kevin Yang, 1225 Via Coronel, Palos Verdes Est., CA (US) 90274

( * ) Notice: Subject to any disclaimer, the term of this patent is extended or adjusted under 35 U.S.C. 154(b) by 158 days.

(21) Appl. No.: 12/313,242

(22) Filed: Nov. 18, 2008

(65) Prior Publication Data

US 2010/0124051 A1 May 20, 2010

(51) Int. Cl.
*F21S 4/00* (2006.01)
*F21V 23/02* (2006.01)

(52) U.S. Cl. ..... 362/221; 362/217.05; 362/217.08; 362/217.1; 362/362

(58) Field of Classification Search ..... 362/217.01, 362/217.05, 217.08–217.17, 221–222, 362, 362/364–365; 206/701, 718
See application file for complete search history.

(56) References Cited

U.S. PATENT DOCUMENTS 2,835,788 A * 5/1958 Phillips ..... 362/219
5,207,504 A * 5/1993 Swift et al. ..... 362/260
6,663,261 B1 * 12/2003 Rhee ..... 362/267

* cited by examiner

*Primary Examiner*—Jason Moon Han
(74) *Attorney, Agent, or Firm*—Clement Cheng

(57) ABSTRACT

The main housing is formed as an elongated plastic hollow molded top cover having a ballast recess and a pair of line openings. The ballast is placed in the ballast recess. The seal ring provides a watertight seal against line opening when locking ring is secured to the ballast. The main housing is mounted to a building surface. A reflector fits between the main housing and a pair of bulbs. The bulbs are retained in end terminals. A main seal bits between main housing and main cover. The clip junction on the main cover receives a housing clip. The housing clip biases the main cover against the main housing with the main seal in between forming a watertight seal.

18 Claims, 6 Drawing Sheets

WEATHER RESISTANT FLORESCENT FIXTURE

DISCUSSION OF RELATED ART

In outdoor weather proof florescent light housings, the ballast is typically mounted within the main housing and sealed with a number of fluorescent bulbs. Typically, an upper housing is sealed with a lower cover at a waterproof silicon circle seal. Sometimes housing clips are used to clip the upper housing to the lower cover. A wide variety of florescent housings have been constructed for outdoor weather proof use.

SUMMARY OF THE INVENTION

The present invention relates to a ballast tray mounting for a weather resistant, water resistant or waterproof florescent fixture. The main housing is formed as an elongated plastic hollow molded top cover having a ballast recess and a pair of line openings. The ballast is placed in the ballast recess. The seal ring provides a watertight seal against line opening when locking ring is secured to the ballast. The main housing is mounted to a building surface. A reflector fits between the main housing and a pair of bulbs. The bulbs are retained in end terminals. A main seal bits between main housing and main cover. The clip junction on the main cover receives a housing clip. The housing clip biases the main cover against the main housing with the main seal in between forming a watertight seal.

The main housing has a trapezoidal side profile with a wider bottom portion than a top portion. The bottom portion is adapted to the shape of the reflector. The end terminals are mounted to the reflector. The bulbs are mounted in turn to the end terminals. The main seal is preferably of a rectangular profile fitting with the shape of the bottom portion of the main housing. The main cover is also of a trapezoidal side profile with a wider top portion than a bottom portion. The main cover top portion has a shape conforming with the shape of the main housing bottom portion and the main seal.

A total of eight housing clips comprise four on each of the front and back sides of the main housing. The clip junction provides a connection receiving area for attachment of housing clips.

The tray collar receives a seal ring. The ballast is housed within a ballast tray. The lines run through the seal ring, the line opening and the locking ring. The locking ring secures to the collar after the collar is extended through the line opening. The exterior surface of the ballast tray is shaped to conform to the main housing. Electrical input is received through mounting holes. Mounting holes are sized to receive flexible electrical conduit from a wall, or ceiling of a building.

The ballast tray has been secured to the main housing and the locking ring formed as a nut is securing the collar against the seal ring forming a watertight connection. A ballast is placed within a ballast tray. The lines of the ballast are passed through the tray collar which is formed on the tray cover. The tray seal fits between the tray cover and the ballast tray. Tray screw openings disposed on the tray cover allow screws to secure the tray cover against the tray screw receiver formed on the ballast tray. The tray seal, the seal ring and the main seal are preferably made of the same elastomeric, preferably silicone type of seal. The seals define separate sections, namely the tray unit, and the main housing.

An object of the invention is to provide a more reliable ballast configuration. A second object of the invention is to decrease the temperature in the main housing.

The following call a list of elements can be a helpful guide in referencing the elements of the drawings.

40 Tray Unit
41 Tray Screw Opening
42 Tray Seal
43 Electronic Ballast Assembly
44 Tray Cover
45 Tray Screw Receiver
46 Tray Collar
50 Main Housing
52 Reflector
54 Bulb
56 End Terminals
62 Main Seal
64 Main Cover
71 Ballast Tray
72 Ballast
74 Ballast Recess
76 Seal Ring
78 Line Opening
79 Locking Ring
81 Clip Junction
82 Housing Clip
88 Mounting Holes

DETAILED DESCRIPTION OF THE PREFERRED EMBODIMENT

Figure 1:
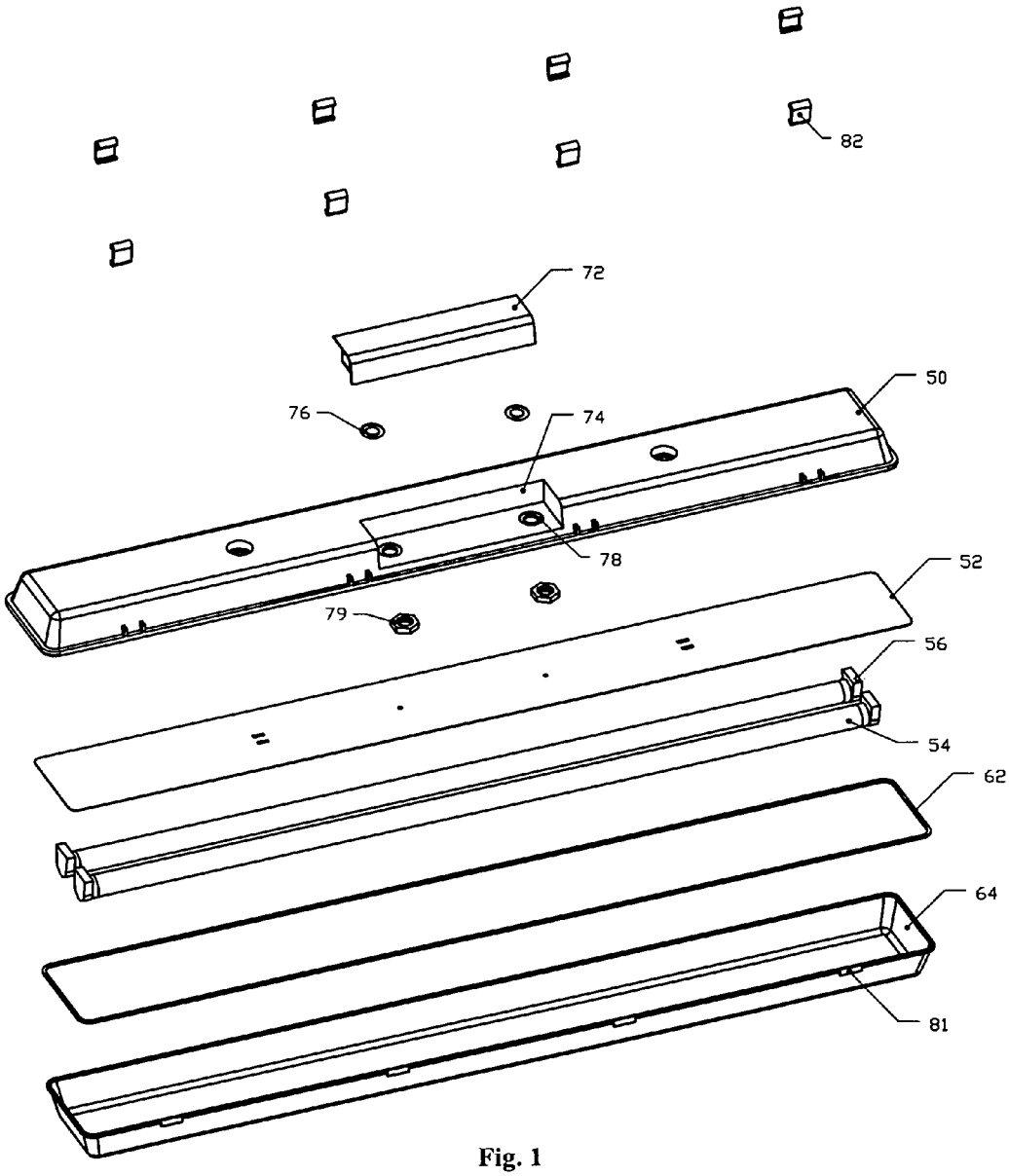
FIG. 1 is an exploded view of the present invention.

As seen in FIG. 1, the main housing 50 is formed as an elongated plastic hollow molded top cover having a ballast recess 74 and a pair of line openings 78. The ballast 72 is placed in the ballast recess 74. The seal ring 76 provides a watertight seal against line opening 78 when locking ring 79 is secured to the ballast 72. The main housing 50 is mounted to a building surface. A reflector 52 fits between the main housing and a pair of bulbs 54. The bulbs are retained in end terminals 56. A main seal 62 bits between main housing 50 and main cover 64. The clip junction 81 on the main cover 64 receives a housing clip 82. The housing clip 82 biases the main cover 64 against the main housing 50 with the main seal 62 in between forming a watertight seal.

The main housing 50 has a trapezoidal side profile with a wider bottom portion than a top portion. The bottom portion is adapted to the shape of the reflector 52. The end terminals 56 are mounted to the reflector 52. The bulbs 54 are mounted in turn to the end terminals 56. The main seal 62 is preferably of a rectangular profile fitting with the shape of the bottom portion of the main housing 50. The main cover 64 is also of a trapezoidal side profile with a wider top portion than a bottom portion. The main cover top portion has a shape conforming with the shape of the main housing bottom portion and the main seal 62. The conforming shape provides a flush continuity between the top surface of the main housing and the top surface of the ballast tray.

A ballast recess formed on the main housing is preferably in between the ends of the main housing. The main housing has a long dimension forming a longitudinal direction. The ballast recess is preferably formed at a longitudinal corner of the main housing so that the ballast recess provides a recess on a top face of the main housing and a longitudinal side face of the main housing. A total of eight housing clips 82 comprise four on each of the front and back sides of the main housing. The clip junction 81 provides a connection receiving area for attachment of housing clips 82.

Figure 2:
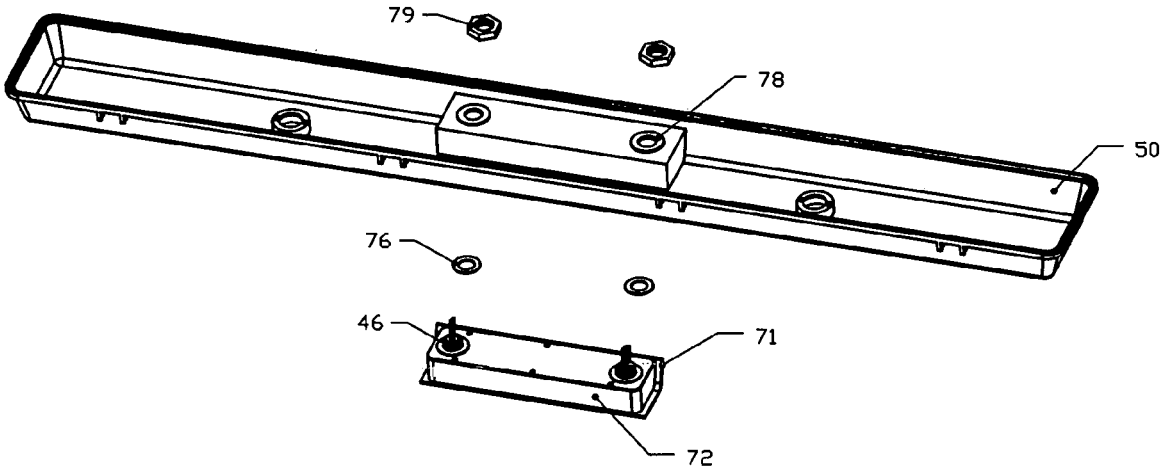
FIG. 2 is a bottom perspective view of the ballast tray assembling to the main housing.

As seen in FIG. 2, the tray collar 46 receives a seal ring 76. The ballast 72 is housed within a ballast tray 71. The ballast is preferably an electronic ballast. The lines run through the seal ring, the line opening 78 and the locking ring 79. The locking ring secures to the collar 46 after the collar is extended through the line opening 78. The locking ring is preferably a threaded nut, but can also be a circlip. The exterior surface of the ballast tray 71 is shaped to conform to the main housing 50. Electrical input is received through mounting holes 88. Mounting holes 88 are sized to receive flexible electrical conduit from mounting surfaces such as a wall, or ceiling of a building.

Figure 3:
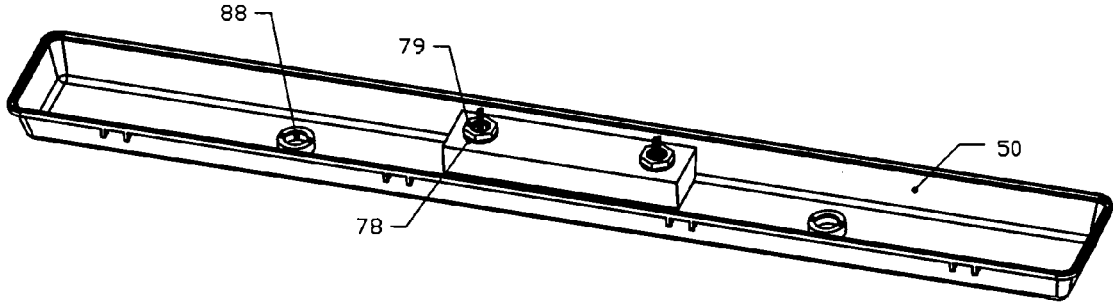
FIG. 3 is a bottom perspective view of the ballast tray assembled to the main housing.
Figure 4:
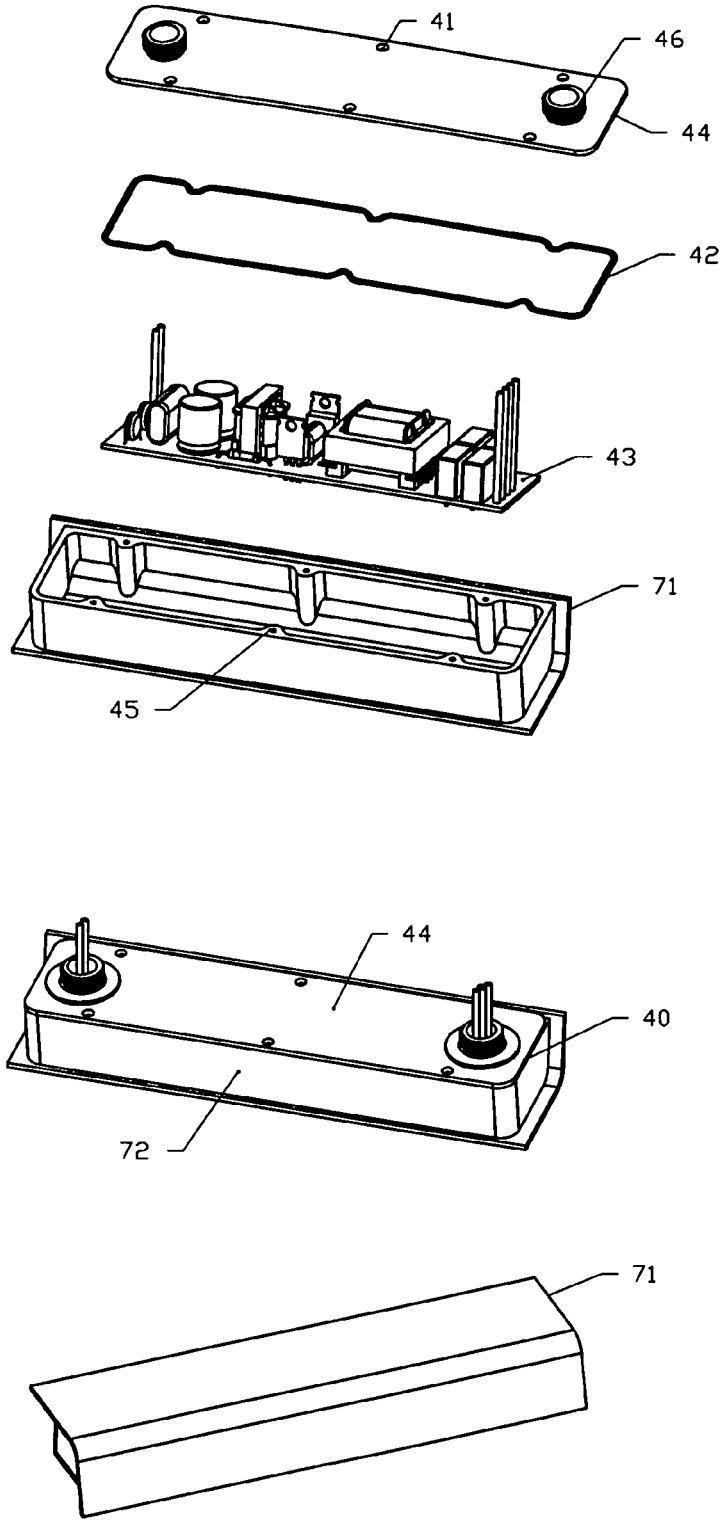
FIG. 4 is an exploded view of the tray unit assembly.

As seen in FIG. 3, the ballast tray has been secured to the main housing and the locking ring 79 formed as a nut is securing the collar 46 against the seal ring 76 forming a watertight connection. FIG. 4 shows the assembly of the tray unit 40. A ballast 72 is placed within a ballast tray 71. The lines of the ballast 72 are passed through the tray collar 46 which is formed on the tray cover 44. Line openings are preferably formed on an upper surface of the tray cover. The tray seal 42 fits between the tray cover 44 and the ballast tray 71. Tray screw openings 41 disposed on the tray cover 44 allow screws to secure the tray cover 44 against the tray screw receiver 45 formed on the ballast tray 71. The tray seal 42, the seal ring 76 and the main seal 62 are preferably made of the same elastomeric, preferably silicone type of seal. The seals define separate sections, namely the tray unit 40, and the main housing 50.

Figure 5:
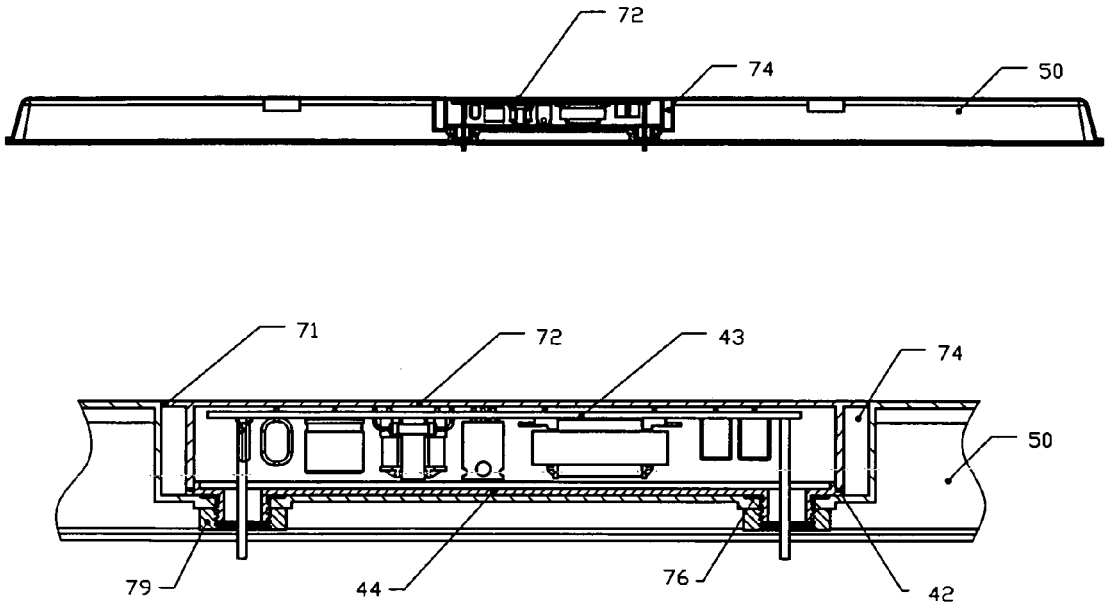
FIG. 5 is a cross section view of the tray assembly assembled to the main housing.
Figure 6:
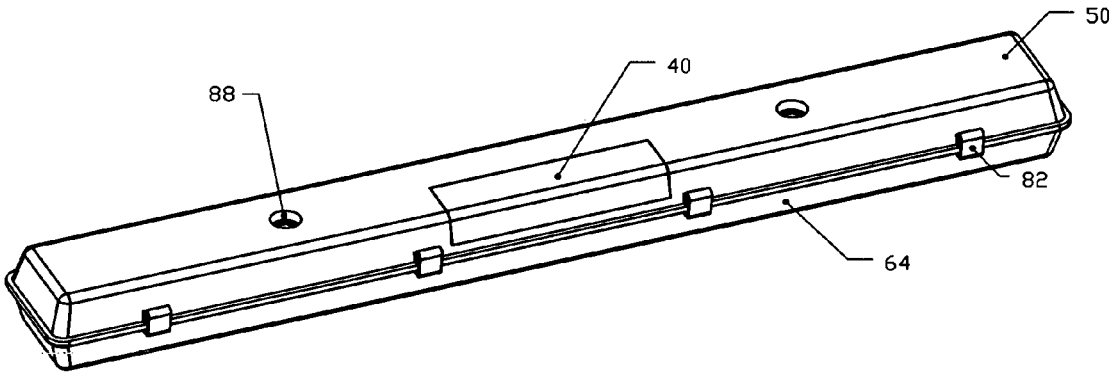
FIG. 6 is an assembled view.

FIG. 5 shows an electronic ballast assembly 43 portion of the ballast 72 which in turn is put into ballast tray 71. FIG. 6 shows where the main housing comprises the upper portion of the device, and where the tray unit 40 is in an upper side corner location relative to the main housing. The mounting holes 88 are optionally threaded for receiving conduit attachment.

The invention claimed is:

1. A weather resistant fluorescent fixture comprising:

a. a main housing formed as a top cover;

b. a ballast recess formed on the main housing;

c. a ballast tray unit comprising a ballast tray, a tray cover secured to the ballast tray, a tray seal disposed between the ballast tray and the tray cover, an electronic ballast housed within the ballast tray and a pair of line openings formed on an upper surface of the tray cover, wherein the external surface of the ballast tray conforms to the external surface of the main housing when the ballast tray is installed in the ballast recess, and wherein a conforming shape provides a flush continuity between a top surface of the main housing and a top surface of the ballast tray;

d. a main cover fitting with the main housing;

e. a main seal providing a watertight seal between the main housing and main cover;

f. a reflector installed between the main housing and the main cover;

g. a pair of end terminals mounted on the reflector;

h. a fluorescent bulb retained between the end terminals.

2. The weather resistant fluorescent fixture of claim 1, further comprising:

a. a tray collar formed on an upper surface of the tray cover; and b. a locking ring, wherein the tray collar receives a locking ring which secures the ballast tray to the main housing.

3. The weather resistant fluorescent fixture of claim 2, wherein electrical lines of the ballast run through the seal ring, the line opening and the locking ring, wherein the locking ring secures to the collar after the collar is extended through the line opening.

4. The weather resistant fluorescent fixture of claim 1, further comprising: a plurality of clip junctions formed on the main cover and main housing; and a plurality of housing clips, each housing clip attaching to a clip junction for biasing the main cover against the main housing forming a watertight seal.

5. The weather resistant fluorescent fixture of claim 1, wherein the main housing has a trapezoidal side profile with a wider bottom portion than a top portion, wherein the bottom portion is adapted to the shape of the reflector, wherein the main seal is of a rectangular profile fitting with the shape of the bottom portion of the main housing, wherein the main cover is also of a trapezoidal side profile with a wider top portion than a bottom portion, wherein the main cover top portion has a shape conforming with the shape of the main housing bottom portion and the main seal.

6. The weather resistant fluorescent fixture of claim 1, further comprising: a tray collar receiving a seal ring, wherein the electronic ballast is housed within the ballast tray.

7. The weather resistant fluorescent fixture of claim 1, wherein the exterior surface of the ballast tray is shaped to conform to the main housing, further comprising mounting holes, wherein electrical power is received through the mounting holes which are sized to receive flexible electrical conduit from a mounting surface.

8. The weather resistant fluorescent fixture of claim 1, wherein the ballast tray is secured to the main housing and the locking ring formed as a nut is securing the collar against the seal ring forming a watertight connection.

9. The weather resistant fluorescent fixture of claim 1, wherein the tray seal fits between the tray cover and the ballast tray providing a watertight seal, wherein tray screw openings disposed on the tray cover allow screws to secure the tray cover against the tray screw receiver formed on the ballast tray.

10. A weather resistant fluorescent fixture comprising:

a. a main housing formed as a top cover;

b. a ballast recess formed on the main housing, wherein the ballast recess is formed at a longitudinal corner of the main housing, wherein the ballast recess provides a recess on a top face of the main housing and a longitudinal side face of the main housing;

c. a ballast tray unit comprising a ballast tray, a tray cover secured to the ballast tray, a tray seal disposed between the ballast tray and the tray cover, an electronic ballast housed within the ballast tray and a pair of line openings formed on an upper surface of the tray cover, wherein the external surface of the ballast tray conforms to the external surface of the main housing when the ballast tray is installed in the ballast recess, and wherein a conforming shape provides a flush continuity between a top surface of the main housing and a top surface of the ballast tray;

d. a main cover fitting with the main housing;

e. a main seal providing a watertight seal between the main housing and main cover;

f. a reflector installed between the main housing and the main cover;

g. a pair of end terminals mounted on the reflector;

h. a fluorescent bulb retained between the end terminals.

11. The weather resistant fluorescent fixture of claim 10, further comprising:

a. a tray collar formed on an upper surface of the tray cover; and b. a locking ring, wherein the tray collar receives a locking ring which secures the ballast tray to the main housing.

12. The weather resistant fluorescent fixture of claim 11, wherein electrical lines of the ballast run through the seal ring, the line opening and the locking ring, wherein the locking ring secures to the collar after the collar is extended through the line opening.

13. The weather resistant fluorescent fixture of claim 1, further comprising: a plurality of clip junctions formed on the main cover and main housing; and a plurality of housing clips, each housing clip attaching to a clip junction for biasing the main cover against the main housing forming a watertight seal.

14. The weather resistant fluorescent fixture of claim 10, wherein the main housing has a trapezoidal side profile with a wider bottom portion than a top portion, wherein the bottom portion is adapted to the shape of the reflector, wherein the main seal is of a rectangular profile fitting with the shape of the bottom portion of the main housing, wherein the main cover is also of a trapezoidal side profile with a wider top portion than a bottom portion, wherein the main cover top portion has a shape conforming with the shape of the main housing bottom portion and the main seal.

15. The weather resistant fluorescent fixture of claim 10, further comprising: a tray collar receiving a seal ring, wherein the electronic ballast is housed within the ballast tray.

16. The weather resistant fluorescent fixture of claim 10, wherein the exterior surface of the ballast tray is shaped to conform to the main housing, further comprising mounting holes, wherein electrical power is received through the mounting holes which are sized to receive flexible electrical conduit from a mounting surface.

17. The weather resistant fluorescent fixture of claim 10, wherein the ballast tray is secured to the main housing and the locking ring formed as a nut is securing the collar against the seal ring forming a watertight connection.

18. The weather resistant fluorescent fixture of claim 10, wherein the tray seal fits between the tray cover and the ballast tray providing a watertight seal, wherein tray screw openings disposed on the tray cover allow screws to secure the tray cover against the tray screw receiver formed on the ballast tray.

* * * * *